US007339552B2

(12) United States Patent
Seki et al.

(10) Patent No.: US 7,339,552 B2
(45) Date of Patent: Mar. 4, 2008

(54) DOT MATRIX TYPE DISPLAY DEVICE AND INFORMATION EQUIPMENT EMPLOYING THE SAME

(75) Inventors: Shuichi Seki, Yonezawa (JP); Norikazu Mito, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 653 days.

(21) Appl. No.: 10/847,436

(22) Filed: May 18, 2004

(65) Prior Publication Data

US 2004/0239663 A1 Dec. 2, 2004

(30) Foreign Application Priority Data

May 29, 2003 (JP) ..... 2003-152169

(51) Int. Cl.
*G09G 3/20* (2006.01)

(52) U.S. Cl. ..... 345/55; 345/56

(58) Field of Classification Search ..... 345/156, 345/3.2, 211, 1.3, 693, 55–76, 589–605; 315/169.1, 169.3
See application file for complete search history.

(56) References Cited

U.S. PATENT DOCUMENTS 4,358,761 A * 11/1982 Iwasaki ..... 345/56
6,297,787 B1 * 10/2001 Nishida ..... 345/1.3
7,106,353 B2 * 9/2006 Shigeta ..... 345/698
7,196,700 B1 * 3/2007 Aho et al. ..... 345/211
2001/0035874 A1 * 11/2001 Hamilton et al. ..... 345/682
2005/0219229 A1 * 10/2005 Yamaguchi ..... 345/173
2005/0259089 A1 * 11/2005 Yamazaki et al. ..... 345/682

FOREIGN PATENT DOCUMENTS

JP 2000-227775 8/2000

* cited by examiner

*Primary Examiner*—Nitin I. Patel
(74) *Attorney, Agent, or Firm*—Westerman, Hattori, Daniels & Adrian, LLP.

(57) ABSTRACT

The present invention is to provide a dot matrix type display device by self light emitting elements in which a display burning phenomenon can be prevented from occurring. With the dot matrix type display device according to the present invention, in the display device in which a plurality of self light emitting elements are arranged in a dot matrix pattern, one or more icons, pictures, letters/characters, and the like are displayed at least on a part of a display area of the display device. The display origin of said one or more icons, pictures, letters/characters, and the like are moved at least one dot or more and displayed by movement display means one after another.

11 Claims, 3 Drawing Sheets

DOT MATRIX TYPE DISPLAY DEVICE AND INFORMATION EQUIPMENT EMPLOYING THE SAME

BACKGROUND OF THE INVENTION

1. Field of the Invention

The present invention relates to a display device in which self light emitting pixels are arranged in a matrix pattern, for example a display device in which organic EL (electroluminescent) elements are used as light emitting pixels, and particularly to a dot matrix type display device in which a display burning phenomenon can be prevented from occurring and to information equipment employing this display device.

2. Description of the Related Art

A display employing a display panel which is constructed by arranging light emitting elements in a matrix pattern has been developed widely. As the light emitting element employed in such display panel, an organic EL element in which an organic material is employed in a light emitting layer has attracted attention, and a self-emitting type display in which the organic EL elements are arranged in a matrix pattern has been commercialized partly. This is because of a background that by employing, in a light emission functional layer constituting an EL element, an organic compound which enables an excellent light emission characteristic to be expected, progress in a high efficiency and a long life by which an EL element can be fit for practical use has been made.

As a display panel employing the above-mentioned organic EL elements, a passive matrix type display panel in which EL elements are simply arranged in a matrix pattern and an active matrix type display panel in which respective active elements for example constituted by TFTs (thin film transistors) are added to respective EL elements arranged in a matrix pattern have been proposed. In either form of the display panel described above, it has been known that the light emission intensity of the EL element arranged therein gradually deteriorates due to changes with time.

Specifically, in the case where a dot matrix type display panel in which the EL elements are arranged in a matrix pattern continues displaying the same display data (still image) for a long period of time, by this continuation, degradation of the EL element which has been driven to emit light progresses, whereby its light emission intensity deteriorates. In this state, in the case where a video signal for allowing the entire display panel to emit light uniformly is received, EL elements whose degradation has progressed emit light which is darker than that of other EL elements, and there occurs a phenomenon, a so-called display burning phenomenon in which the image of a still picture which had been displayed continuously for a long period of time is reproduced as if it were a photographically negative display.

Adopting, in a cellular telephone or other portable information equipment, particularly the dot matrix type display panel in which the EL elements are employed as pixels has been promising. What is more, in this type of information equipment, there occurs an occasion frequently in which an still image of a specific icon, picture, letter/character, and the like is displayed for a long period of time for example on a top page of the display or the like, whereby a countermeasure for the display burning phenomenon becomes necessary.

Meanwhile, it has been known that such display burning phenomenon occurs for example in a CRT, plasma display, or the like, and a countermeasure therefor is disclosed for example in Japanese Patent Application Laid-Open No. 2000-227775 (paragraphs 0009 to 0016 and FIGS. 1 and 2) described below.

The countermeasure for preventing burning disclosed in the above-described Patent Gazette is that a timer is provided in a display device such as for example a plasma display or the like to control the display so that an image is moved at predetermined time intervals. However, with this countermeasure, a problem occurs in which the image moves unexpectedly based on a time-up of the timer in a state in which the display image is stared, and as a result, a feeling that something is wrong is given to a user.

SUMMARY OF THE INVENTION

It is an object of the present invention to provide a dot matrix type display device which particularly can be adopted appropriately in a dot matrix type display device in which at least one icon, picture, letter/character, and the like are displayed and in which display image burning can be prevented without giving a user a feeling of wrongness as described above and to provide information equipment employing such display device.

A display device according to the present invention which has been developed to carry out this object is a display device in which a plurality of self light emitting elements are arranged in a dot matrix pattern and is characterized in that at least one icon, picture, letter/character, and the like are displayed at least on a part of a display area of the display device and that movement display means for allowing a display origin of said at least one icon, picture, letter/character, and the like to be moved at least one dot or more and to be displayed is provided.

Information equipment according to the present invention which has been developed to carry out the object is provided with the dot matrix type display device as means for displaying information and is characterized by comprising operation detection means for detecting that any of manual operations is performed in the information equipment for outputting a control signal and by the movement display means being constructed so as to implement a movement operation for the display origin upon reception of the control signal from the operation detection means.

DESCRIPTION OF THE PREFERRED EMBODIMENTS

Figure 1:
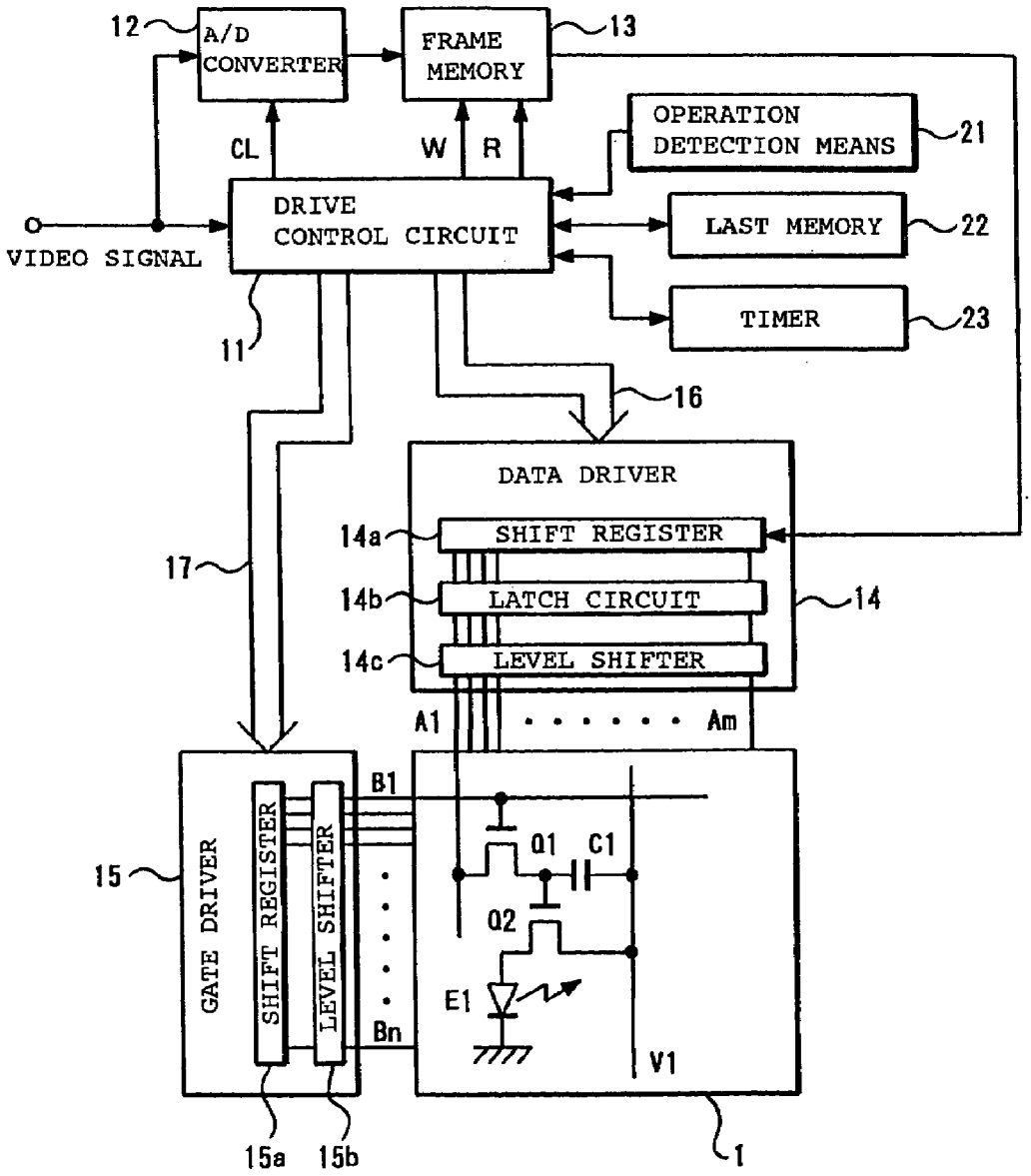
FIG. 1 is a block diagram showing an example of a lighting drive circuit including a dot matrix type display device according to the present invention.

A dot matrix type display device according to the present invention and information equipment adopting this device will be described below with reference to an embodiment shown in the drawings. Although an active matrix type display device in which organic EL elements are employed is exemplified as a display device and is described below, the present invention does not adhere to such form and can also be applied for example to a passive matrix type display device.

First, FIG. 1 shows a dot matrix type display device according to the present invention and information equipment adopting this device. In this dot matrix type display device, as a structural example of one pixel is representatively shown in a display panel 1, this pixel is composed of a control TFT Q1, a drive TFT Q2, a capacitor C1, and an organic EL element E1.

The gate of the control TFT Q1 is connected to a scan electrode line B1 extended from a gate driver 15 described later, and the source of this control TFT Q1 is connected to a data electrode line A1 extended from a data driver 14 described similarly later. Further, the drain of the control TFT is connected to the gate of the drive TFT Q2 and to one end of the capacitor C1.

The drain of the drive TFT Q2 is connected to a power supply line V1, and the other end of the capacitor C1 is also connected to the power supply line V1. Further, the source of the drive TFT is connected to the anode of the organic EL element E1, and the cathode of the organic EL element E1 is connected to a reference voltage point.

In the above-described structure, when an ON voltage is supplied to the gate of the control TFT Q1, the control TFT allows current corresponding to voltage pixel data supplied to the source to flow from the source to the drain. During the period in which the gate of the control TFT is the ON voltage, the capacitor C1 is charged by current based on the source voltage. Then, such charge voltage is supplied to the gate of the drive TFT Q2, and the drive TFT allows current based on the gate voltage thereof and the voltage supplied from the power supply line V1 to flow in the organic EL element, whereby the EL element E1 emits light.

Meanwhile, when the gate of the control TFT Q1 becomes an OFF voltage, the control TFT becomes a so-called cutoff, and the drain of the control TFT becomes in an open state. Thus, the gate voltage of the drive TFT Q2 is maintained by the electrical charges accumulated in the capacitor C1. Drive current to the EL element E1 by the drive TFT is maintained until the next scan, whereby light emission of the EL element is also maintained.

Respective pixel structures described above are similarly formed at the positions of intersection points between respective data electrode lines A1 to Am from the data driver 14 described later and respective scan electrode lines B1 to Bn from the gate driver 15 described later, thereby to construct the dot matrix type display panel 1.

Meanwhile, in FIG. 1, a drive circuit for driving lighting of the dot matrix type display panel 1 with the above-described structure and generation means of a control signal or the like received from an information equipment side in the case where said drive circuit is loaded in the information equipment are shown through a block diagram. A video signal to be displayed on the dot matrix type display device 1 is supplied to a drive control circuit 11 and an analogue/digital (A/D) converter 12. The drive control circuit 11 generates a clock signal CL for the A/D converter 12 and a write signal W and a read signal R for a frame memory 13 based on a horizontal synchronization signal and a vertical synchronization signal in the video signal.

The A/D converter 12 samples the inputted video signal based on the clock signal CL supplied from the drive control circuit 11 and converts it to pixel data corresponding to each one pixel to supply it to the frame memory 13. The frame memory 13 operates so as to write respective pixel data supplied from the A/D converter 12 in the frame memory 13 one after another by the write signal W supplied from the drive control circuit 11.

When writing of pixel data of one screen (m columns and n rows) part in the display panel is completed by such write operation, the frame memory 13 sequentially supplies serial pixel data which is read out for one row part, for example from the first row to the nth row by the read signal R supplied from the drive control circuit 11 to a shift register 14*a* in a data driver 14.

At this time, a clock signal, a start signal, a latch signal, and the like are supplied from the drive control circuit 11 to the data driver 14 via a bus line 16. At the same time, a scan clock signal, a scan start signal, and the like are supplied from the drive control circuit 11 via a bus line 17. Based on these signals the gate driver 15 sequentially sends gate ON voltages to respective scan lines as described later.

Provided in the data driver 14 are the shift register 14*a* which takes serial pixel data of one horizontal period part as parallel data according to a clock signal upon reception of a start signal synchronous with a clock signal supplied via the bus line 16, a latch circuit 14*b* latching, at one time, pixel data of one horizontal period part supplied from the shift register 14*a* based on the latch signal outputted at the time of completion of one horizontal period, and a level shifter 14*c* converting respective pixel data latched by the latch circuit 14*b* to a predetermined level to output it to the display panel 1.

Provided in the gate driver 15 are a shift register 15*a* sequentially taking a gate control signal for example corresponding to one frame in accordance with a scan clock signal upon reception of a scan start signal synchronous with a scan clock signal supplied via the bus line 17 during an address period and a level shifter 15*b* converting the gate control signal taken in this shift register 15*a* to a predetermined level to output it to the display panel 1.

In the display panel 1, a large number of data electrode lines A1 to Am each of which is connected to the level shifter 14*a* in the data driver 14 are arranged in a column direction, and a large number of scan electrode lines B1 to Bn each of which is connected to the level shifter 15*b* in the gate driver 15 are arranged in a row direction. Thus, respective pixels formed at the intersection point positions between the respective data electrode lines Al to Am and the respective scan electrode lines B1 to Bn in the display panel 1 are selectively driven to be lit based on the inputted video signal, and an image in accordance with this video signal is displayed on the display panel 1.

Reference numerals 21 to 23 denote circuit blocks arranged mainly in a information equipment side in which a display device composed of the display panel 1 and a drive circuit is loaded. In the case of exemplifying for example a cellular telephone the information equipment, the reference numeral 21 is operation detection means, and this means is constructed so that when an operation power supply of the telephone is turned on, when the telephone is opened in the case where the telephone is a folding type, and when a key operation is performed, and the like, these operations are detected so that one or more control signals are outputted. This control signal is supplied to the drive control circuit 11.

The reference numeral 22 is a last memory composed of a nonvolatile memory such as for example EEPROM or the like, and this memory is to store positional information of a display origin displayed lastly in the case where the display origin of an image displayed on the display panel 1 is moved for each dot and is displayed as described later. This memory functions so as to receive the positional information of the display origin displayed lastly from the drive control circuit 11 to store it and to supply this stored information to the drive control circuit 11.

Further, the reference numeral 23 is a timer in which a time-up occurs after a predetermined amount of elapsed time, and this timer functions so as to supply time-up data to the drive control circuit 11 when elapsed time data is zero reset followed by starting of counting time and then a predetermined amount of time is counted, upon reception of a reset signal from the drive control circuit 11. Respective interactions of the operation detection means 21, the last memory 22, and the timer 23 will be described in detail along with explanation for interactions of movement display means for an image displayed on the display panel 1 described later, that is, a display image burning prevention measure.

Figure 2:
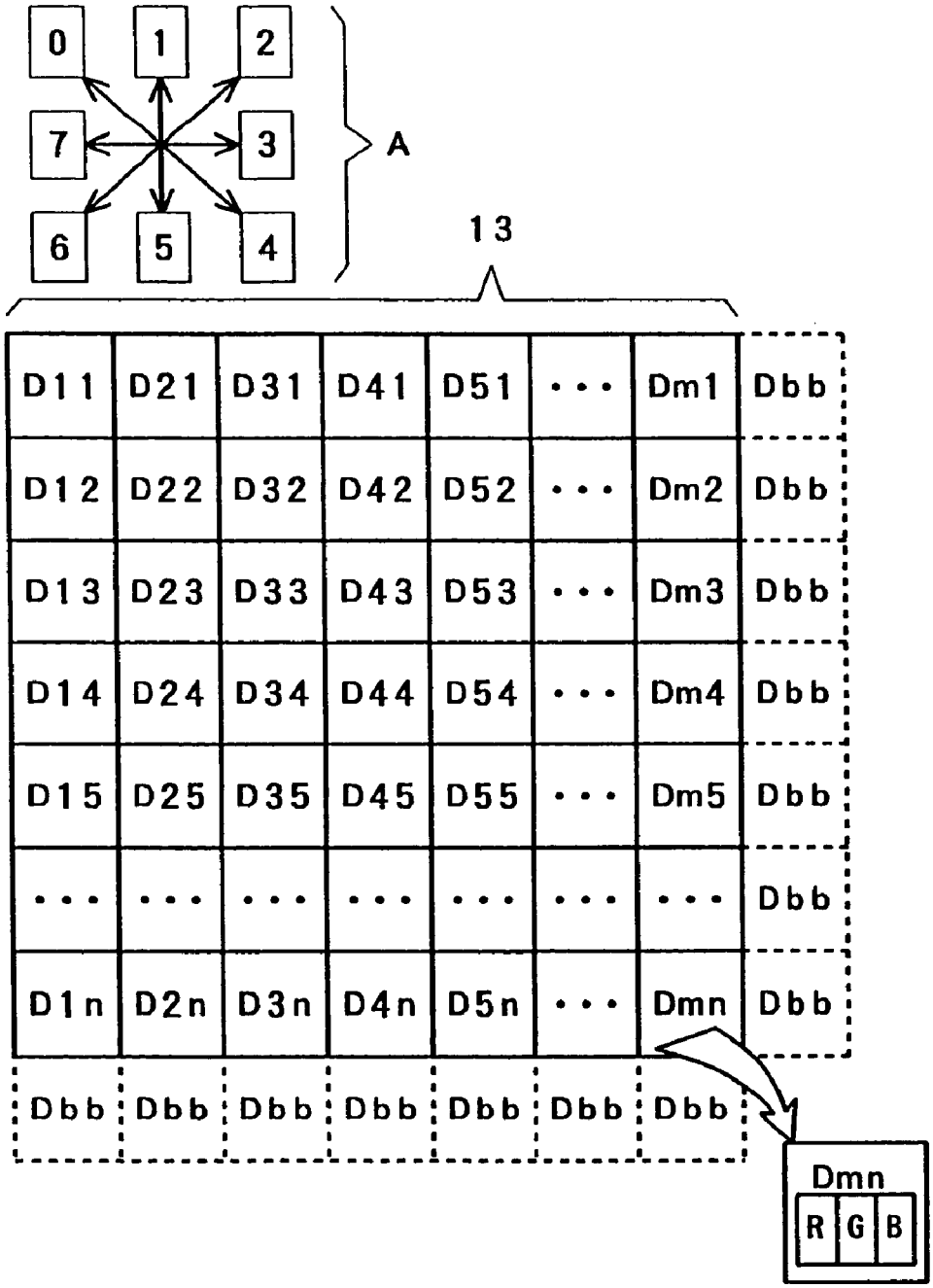
FIG. 2 is a schematic view showing an example for realizing an operation for moving a display image performed in the lighting drive circuit shown in FIG. 1.

FIG. 2 explains the movement display means for an image. This movement display means for an image in the dot matrix type display device according to the present invention can move the display origin for each pixel on the display panel 1, that is, for each dot unit. With respect to a movement display operation for example for a still image on this display panel, processing can be performed when respective pixel data corresponding to one frame is written in the frame memory 13 shown in FIG. 1, and also processing can be performed when respective pixel data corresponding to one frame is read out of the frame memory 13. Here, a processing example in the case where movement display for an image is implemented when the pixel data is read out of the frame memory 13 will be described with reference to FIG. 2.

Reference numeral 13 shown in FIG. 2 is one obtained by imaging the frame memory shown in FIG. 1, and respective reference numerals enclosed by ruled line frames shown by the reference numeral 13 in FIG. 2, that is, D11, D21, D31, . . . denote respective pixel data stored in the frame memory 13 shown in FIG. 1. That is, in the frame memory 13, in accordance with the arrangement of respective light emitting elements arranged on the display panel 1, pixel data of m columns part is written for each row, and this is written for n column part, so that pixel data of one frame is stored. When respective pixel data stored in the frame memory 13 is read out, by selecting a read origin, the display origin of an image displayed on the display panel 1 can be controlled to be moved substantially.

Respective numerals denoted by "0" to "7" shown by character A in FIG. 2 show coordinate positions of the read origin mentioned above in the case where the respective pixel data stored in the frame memory 13 is read out. In other words, the "0" to "7" can be called administration numbers for defining the display origin of an image.

In this embodiment, in the case where for example the administration number "0" is selected, pixel data is read out in the order of D11, D21, D31, . . . Dm1 in the first scan of an addressing time, and pixel data is read out in the order of D12, D22, D32, . . . Dm2 in the second scan. Similar reading operation is implemented for all pixel data stored in the frame memory 13 corresponding to one frame shown in FIG. 2. As a result, an image is displayed on the display panel 1 with the display origin corresponding to the administration number "0".

In the case where for example the administration number "4" is selected, in the first scan of the addressing time, pixel data is read out sequentially while the third column of the third row in the frame memory 13 is treated as the read origin of X and Y directions. In this case, although pixel data is read out in the order of D33, D43, D53, . . . Dm3 in the first scan, pixel data of the final two rows part of the first scan is lacked. In this case, an operation in which two black display data Dbb is automatically complemented is performed. In the second scan, pixel data is read out in the order of D34, D44, D54, . . . Dm4, and similarly two black display data Dbb is automatically complemented as pixel data of the final two columns part.

Similar reading processing is performed for all pixel data stored in the frame memory 13 corresponding to one frame shown in FIG. 2. In the reading processing of pixel data in the case where the administration number "4" is selected as described above, pixel data corresponding to the final two rows cannot be read out of the frame memory 13. In this case, similarly to the above, black display data Dbb of a two rows part is automatically complemented.

Thus, with given forms of the administration numbers "0" to "7" shown in FIG. 2, by selecting any one of the administration numbers "0" to "7", the display origin for an image can be moved vertically and horizontally within the range of three columns and three rows (three dots by three dots). However, this movement range is determined by the size of the display area of the display panel 1, a dot density formed in the display area, and the like, so that in reality the display origin is moved in a unit of one dot to several dots.

Figure 3:
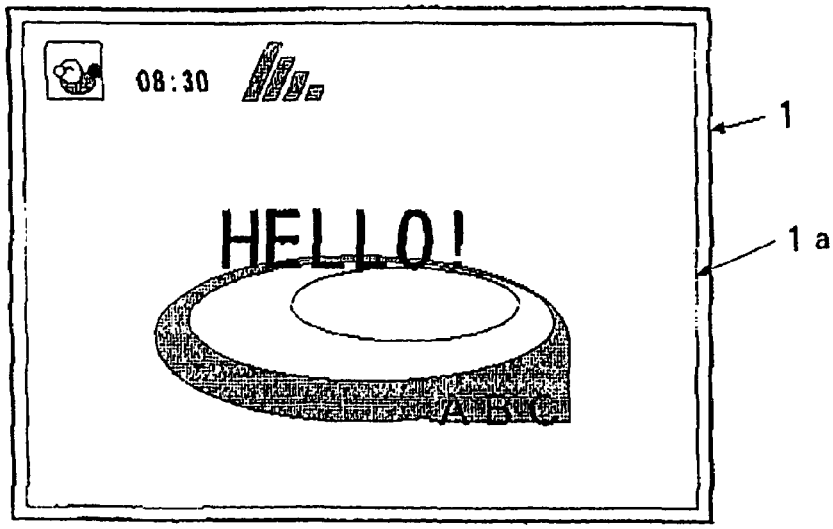
FIG. 3 is a front view showing a display example of an image displayed on a display panel.
Figure 4A:
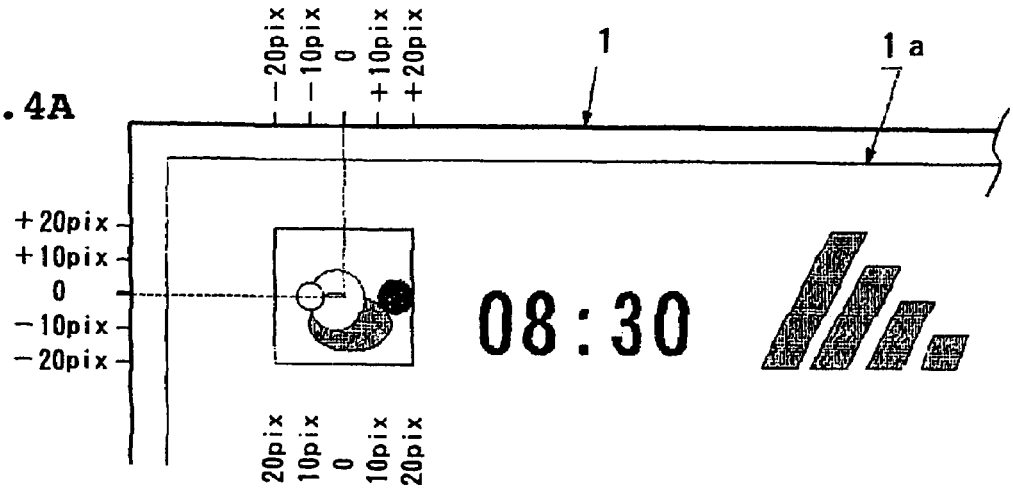
FIG. 4 is enlarged views of a portion of the display panel showing a display example of a movement of an image.
Figure 4B:
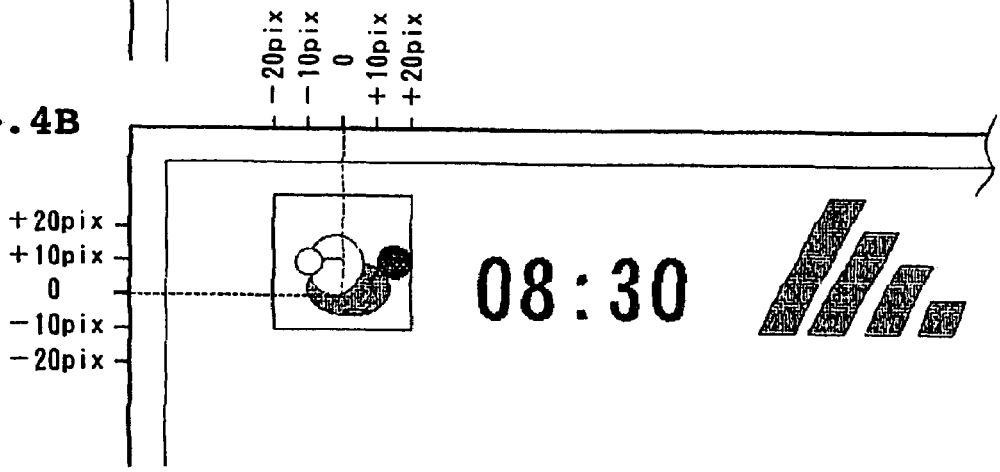

FIGS. 3 and 4 show a display example of an image displayed on a display area 1*a* on the display panel 1 and an example of the case where an image is moved and displayed through the above-described interactions. That is, FIG. 3 shows one example of an entire image displayed on the display area 1*a*. In this case, a part other than an expression showing time shown by numerals wherein a colon is at the center thereof is a still image. FIG. 4A enlarges and shows an upper left part of the display panel 1 shown in FIG. 3, and FIG. 4B shows a state in which an image displayed on the same display panel 1 is moved and displayed.

In FIG. 4, for convenience of explanation, divisions showing a movement amount in dots are drawn on the outer frame part of the display panel 1, and a movement condition shown in FIGS. 4A to 4B show a state in which the entire image including an icon shown in an upper left portion of the display area is moved upwardly about 10 dots.

As described above, the read origin for reading respective pixels out of the frame memory 13 is defined in the X and Y directions, and pixel data is clipped out, so that the image is displayed. Thus, as shown in FIGS. 3 and 4, the entire part is controlled to be moved uniformly without changing the relative positions of one or more icons, still pictures, letters/characters, and the like displayed on the display area 1*a*. Therefore, a user is less given a feeling of wrongness when an image is moved.

Returning to FIG. 1, more preferred forms for executing a movement operation for an image as described above will be described. In one preferred form, the operation detection means 21 shown in FIG. 1 transmits a control signal to the drive control circuit 11 in the case where it is detected that any of manual operations is performed as described above for example in a cellular telephone as information equipment. Upon reception of this signal, the drive control circuit 11 implements the above-mentioned movement operation of the display origin.

In this case, the administration numbers of "0" to "7" shown as one example are utilized, and each time the drive control circuit 11 receives said one or more control signals from the operation detection means 21, the drive control circuit 11 moves the display origin in accordance with the order of ascent or descent of the administration numbers.

In the case where the above-described movement control is executed, since display of an image is moved when for example a user of the cellular telephone operates something, the user can be prevented from coming across a situation in which the image is moved inadvertently at least in a state in which the user is staring at the image.

In the case where control is performed so that while the administration numbers for example shown by "0" to "7" are utilized as described above, the display origin is moved in accordance with the order of ascent or descent, the movement amount of an image moving at one time (number of dots for a movement) can be set within a predetermined range, and an image movement can be realized without giving a user a feeling of wrongness similarly.

As described above, in the case where the administration numbers for example shown by "0" to "7" are utilized, when the operational power supply of information equipment in which this form is adopted is turned off, the administration number which has been used lastly is stored in the last memory 22 shown in FIG. 1. When the operational power supply is next turned on, an movement operation of a display image is performed in accordance with the order of ascent or descent again as the administration number stored in the last memory 22 is the reference. By performing such control, the degree of occurrence of the above-mentioned display burning phenomenon can be reduced as much as possible.

It is also possible to randomly extract any one of the above-described administration numbers for example shown by "0" to "7" while random numbers are used and to control so as to sequentially move the display position of an image in accordance with the extracted administration number. In this case, the last memory 22 becomes unnecessary, whereby a simplification can be achieved.

In the case where the control for moving the display image is performed each time the drive control circuit 11 receives the control signal from the operation detection means 21 as described above, a problem that the movement operation of the display image is excessively frequently performed occurs. In this case, it is preferred that the timer 23 which is zero reset when the movement operation of the display image is implemented and in which a time-up occurs after a predetermined amount of elapsed time is utilized, and that control for moving the display image is performed in a state in which a time-up occurs in the timer 23 and when said one or more control signals from the operation detection means 21 are received.

Although the description above supposes the case where a so-called monochrome display panel in which respective light emitting elements arranged on the display panel emit light of the same color is adopted, the present invention can also be applied to a display device which realizes a full color display for example employing organic EL elements which emit light of respective R (red), G (green), and B (blue) colors. In this case, as shown by clipping the pixel data Dmn shown in FIG. 2, by handling one group in which respective EL elements emitting R, G and B lights are respective subpixels as one pixel data, the display position of the color image can be controlled to be sequentially moved similarly.

What is claimed is:

1. A dot matrix type display device, comprising:

a plurality of self light emitting elements arranged in a dot matrix pattern, wherein at least one icon, picture, letter/character, and the like are displayed at least on a part of a display area of the display device; and movement display means for allowing a display origin of said at least one icon, picture, letter/character, and the like to be moved at least one dot or more and to be displayed, wherein a direction of a movement of the display origin which is moved and displayed by the movement display means is a vertical direction or a horizontal direction on the display area or their combination, and wherein at least two or more of the icons, pictures, letters/characters, and the like are displayed at the same time, and the movement display means comprises means for moving the display origin in such a way that relative positions of said at least two or more icons, pictures, letters/characters, and the like are not changed on the display area.

2. The dot matrix type display device according to claim 1, wherein the self light emitting elements arranged in a dot matrix pattern are constituted by elements which emit light of respective R (red), G (green) and B (blue) colors.

3. The dot matrix type display device according to claim 1 or 2, wherein the self light emitting elements are constituted by organic EL elements.

4. A dot matrix type display device, comprising:

a plurality of self light emitting elements arranged in a dot matrix pattern, wherein at least one icon, picture, letter/character, and the like are displayed at least on a part of a display area of the display device; and movement display means for allowing a display origin of said at least one icon, picture, letter/character, and the like to be moved at least one dot or more and to be displayed, wherein the movement display means is constructed in such a way that the display origin can be set at a plurality of predetermined positions on the display area and that while the respective plural positions are defined by administration numbers, a movement order of the display origin corresponds to the order of ascent or descent of the administration numbers.

5. The dot matrix type display device according to claim 4, wherein the movement display means comprises a non-volatile memory which stores a last administration number showing a set position of the display origin and that setting of a next display origin is performed in accordance with the order of ascent or descent as the administration number which is stored in the memory is a reference.

6. A dot matrix type display device, comprising:

a plurality of self light emitting elements arranged in a dot matrix pattern, wherein at least one icon, picture, letter/character, and the like are displayed at least on a part of a display area of the display device; and movement display means for allowing a display origin of said at least one icon, picture, letter/character, and the like to be moved at least one dot or more and to be displayed, wherein the movement display means is constructed in such a way that the display origin can be set at a plurality of predetermined positions on the display area and that while the respective plural positions are defined by administration numbers, a movement order of the display origin is according to an administration number which is randomly extracted using random numbers.

7. Information equipment provided with a dot matrix type display device comprising a plurality of self light emitting elements arranged in a dot matrix pattern, wherein at least one icon, picture, letter/character, and the like are displayed at least on a part of a display area of the display device; and movement display means for allowing a display origin of said at least one icon, picture, letter/character, and the like to be moved at least one dot or more and to be displayed, as means for displaying information, characterized by comprising operation detection means for detecting that any of manual operations is performed in the information equipment for outputting at least one control signal, wherein the movement display means is constructed so as to implement a movement operation for the display origin upon reception of said at least one control signal from the operation detection means.

8. Information equipment according to claim 7, wherein the information equipment further comprises a timer in which a time-up occurs after a predetermined amount of elapsed time and that in a state in which a time-up occurs in the timer and when said at least one control signal from the operation detection means is received, the movement operation for the display origin is implemented.

9. The dot matrix type display device according to any one of claims 4, 6 or 7, wherein a direction of a movement of the display origin which is moved and displayed by the movement display means is a vertical direction or a horizontal direction on the display area or their combination.

10. The dot matrix type display device according to claim 9, wherein at least two or more of the icons, pictures, letters/characters, and the like are displayed at the same time and that the movement display means comprises means for moving the display origin in such a way that relative positions of said at least two or more icons, pictures, letters/characters, and the like are not changed on the display area.

11. The dot matrix type display device according to any one of claims 4, 6 or 7, wherein at least two or more of the icon, picture, letter/character, and the like are displayed at the same time and that the movement display means comprises means for moving the display origin in such a way that relative positions of said at least one icon, picture, letter/character, and the like are not changed on the display area.

* * * * *